US009420362B1

(12) United States Patent
Daley

(10) Patent No.: US 9,420,362 B1
(45) Date of Patent: Aug. 16, 2016

(54) PERIPHERAL AUDIO OUTPUT DEVICE

(71) Applicant: GOOGLE INC., Mountain View, CA (US)

(72) Inventor: Michael Daley, Santa Clara, CA (US)

(73) Assignee: GOOGLE INC., Mountain View, CA (US)

( * ) Notice: Subject to any disclaimer, the term of this patent is extended or adjusted under 35 U.S.C. 154(b) by 0 days.

(21) Appl. No.: 14/734,474

(22) Filed: Jun. 9, 2015

Related U.S. Application Data

(60) Provisional application No. 62/015,310, filed on Jun. 20, 2014.

(51) Int. Cl.
*H04R 1/02* (2006.01)

(52) U.S. Cl.
CPC ..... *H04R 1/02* (2013.01)

(58) Field of Classification Search
CPC ... G03B 2206/00; H04R 2420/07; H04R 1/02
USPC ..... 381/388, 391; 361/725, 807
See application file for complete search history.

(56) References Cited

U.S. PATENT DOCUMENTS

| | | | | |
|---|---|---|---|---|
| 5,610,992 | A | 3/1997 | Hickman | |
| 7,801,570 | B2 | 9/2010 | Cheung et al. | |
| D658,186 | S | 4/2012 | Akana et al. | |
| D663,304 | S | 7/2012 | Akana et al. | |
| D682,836 | S | 5/2013 | Akana et al. | |
| D682,838 | S | 5/2013 | Akana et al. | |
| D688,669 | S | 8/2013 | Akana et al. | |
| D697,512 | S | 1/2014 | Akana et al. | |
| 8,925,722 | B2 | 1/2015 | Poon et al. | |
| 2007/0230723 | A1* | 10/2007 | Hobson | H01R 13/748 381/300 |
| 2008/0219488 | A1* | 9/2008 | Crooijmans | G06F 1/1632 381/333 |
| 2010/0134984 | A1* | 6/2010 | Lum | G06F 1/1632 361/725 |
| 2012/0066865 | A1* | 3/2012 | Lauder | G06F 1/1626 16/382 |
| 2012/0308064 | A1 | 12/2012 | Matthews | |
| 2013/0058065 | A1* | 3/2013 | Minaguchi | H04N 5/64 361/807 |
| 2015/0027802 | A1 | 1/2015 | Altschul et al. | |
| 2015/0063619 | A1 | 3/2015 | Wenger et al. | |

* cited by examiner

*Primary Examiner* — Brian Ensey
*Assistant Examiner* — Julie X Dang
(74) *Attorney, Agent, or Firm* — Marshall, Gerstein & Borun LLP

(57) ABSTRACT

Embodiments are provided for an improved peripheral speaker. The peripheral speaker includes an exterior casing enclosing one or more drivers. The exterior casing further has a channel formed therein such that the channel is sized to removably secure an electronic device. The exterior casing is equipped with a connector lead which partially defines the cavity and that connects the one or more drivers to a port of the electronic device. The one or more drivers output audio according to an audio signal transmitted from the electronic device via the connector lead.

20 Claims, 6 Drawing Sheets

PERIPHERAL AUDIO OUTPUT DEVICE

CROSS-REFERENCE TO RELATED APPLICATIONS

The present application claims the benefit of U.S. Provisional Application No. 62/015,310, filed Jun. 20, 2014, the disclosure of which is incorporated herein by reference in its entirety.

FIELD

This application generally relates to peripheral speaker systems. In particular, the application relates to a peripheral speaker having electronic device connection capabilities for audio output.

BACKGROUND

Existing portable electronic devices, such as smartphones, have audio output capabilities in the form of built-in speakers. However, due to size limitations of the portable devices, the performance of the built-in speakers is subpar when compared to larger speaker components or systems. Accordingly, users of portable devices will frequently connect the portable devices to peripheral speaker systems for various applications such as music playback, whereby the peripheral speaker systems typically have a greater audio output capacity and better general audio quality than the built-in speakers of the portable devices.

However, existing peripheral speaker systems have limitations. In some cases, the speaker systems are large and bulky, and are therefore not very portable. Further, wireless speakers can prove difficult to pair or connect to the electronic devices, and any resulting wireless connection is not as fast and has a reduced audio quality when compared to a wired connection. Moreover, some speaker systems are not designed or constructed to adequately support the portable devices.

Accordingly, there is an opportunity for improved peripheral speaker systems.

BRIEF DESCRIPTION OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed embodiments, and explain various principles and advantages of those embodiments.

DETAILED DESCRIPTION

Embodiments as detailed herein describe an improved peripheral speaker system for audio output and playback, as well as general device interaction. A peripheral speaker is connectable to various portable electronic devices such as smartphones, MP3 players, and the like. The peripheral speaker includes a connector lead having an adapter configured to be inserted into or connected to a corresponding port of the electronic device. The electronic device can provide audio signals to the peripheral speaker via the connector lead, and the peripheral speaker can output corresponding audio. The peripheral speaker includes a cover extending therefrom, where the cover may be manipulated into various configurations depending on the desired use or application of the peripheral speaker system and/or the electronic device.

The peripheral speaker system has an improved design that affords many benefits and uses. Existing peripheral speakers lack adequate means for supporting corresponding electronic devices. For example, some existing peripheral speakers support electronic devices substantially via an adapter that plugs directly into the electronic devices. However, the support provided by the adapter is not able to withstand sudden movements of the peripheral speaker and/or the connected electronic device, which reduces the portability of the peripheral speaker. Additionally, some peripheral speakers support a wireless connection (e.g., a Bluetooth connection) with the electronic device. However, wireless connections are slow to connect and result in a loss of audio quality when compared to wired connections.

The improved design of the peripheral speaker system as described in the present embodiments includes a channel or groove formed in an exterior casing in which an electronic device may be removably secured. The channel is sized slightly larger than the electronic device such that the channel supports the electronic device when the electronic device is secured within the exterior casing. The peripheral speaker further includes a connector lead extending from the exterior casing and having an adapter that plugs into or connects to a corresponding port of the electronic device. Accordingly, the peripheral speaker of the present embodiments enables improved support while maintaining quality and delay-free audio output. Further, the peripheral speaker of the present embodiments includes a cover component that enables a variety of applications and use cases. Accordingly, because the peripheral speaker systems employ various hardware modules and connection components, the systems are necessarily rooted in computer technology in order to overcome the noted shortcomings that specifically arise in the realm of electronic devices.

Figure 1A:
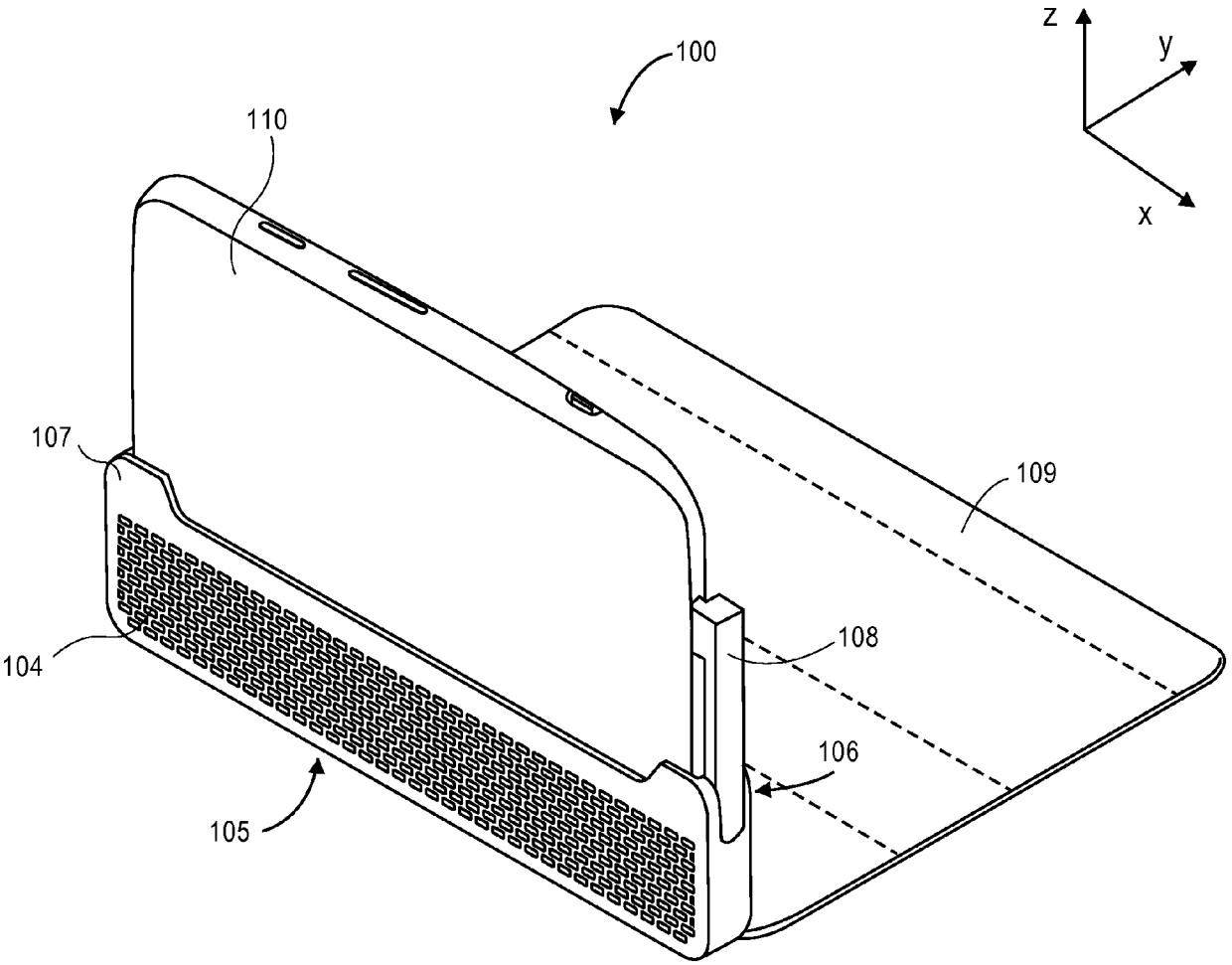
FIG. 1A is a perspective view of an example peripheral speaker system including a peripheral speaker, a cover for the peripheral speaker, and an electronic device, in accordance with some embodiments.

FIG. 1A depicts a perspective view of a peripheral speaker system 100. In particular, the peripheral speaker system 100 includes a peripheral speaker 105 and an electronic device 110. In embodiments, the electronic device 110 may be any type of portable electronic device capable of generating and outputting electrical audio signals. For example, the electronic device 110 may be a mobile phone, a smart phone, a Personal Digital Assistant (PDA), a tablet computer, a notebook computer, a multimedia player, an MP3 player, a digital broadcast receiver, a remote controller, a digital camera, a digital video recorder, or any other electronic apparatus.

The peripheral speaker 105 includes an exterior casing 104 that defines the exterior surface of the peripheral speaker 105. The exterior casing 104 may include a grill that is formed on a front surface of the exterior casing 104. The grill covers and protects any number of individual drivers of varying types (e.g., full-range, subwoofer, mid-range, tweeter, etc.). For example, the peripheral speaker 105 can include four (4) individual full-range drivers that are arranged side-by-side along a length (x-dimension) of the peripheral speaker 105. The individual drivers may produce sound in response to an electrical audio signal input from the electronic device 110, as understood in the art. It should be appreciated that the exterior casing 104 may be composed of one or more materials or combinations of materials such as, for example, plastic, metal, wood, rubber, and/or other materials. Further, different portions or sections of the exterior casing 104 may be composed of different materials or combinations of materials. For example, a bottom surface of the exterior casing 104 may be metal and the remainder of the exterior casing 104 may be plastic.

Figure 1B:
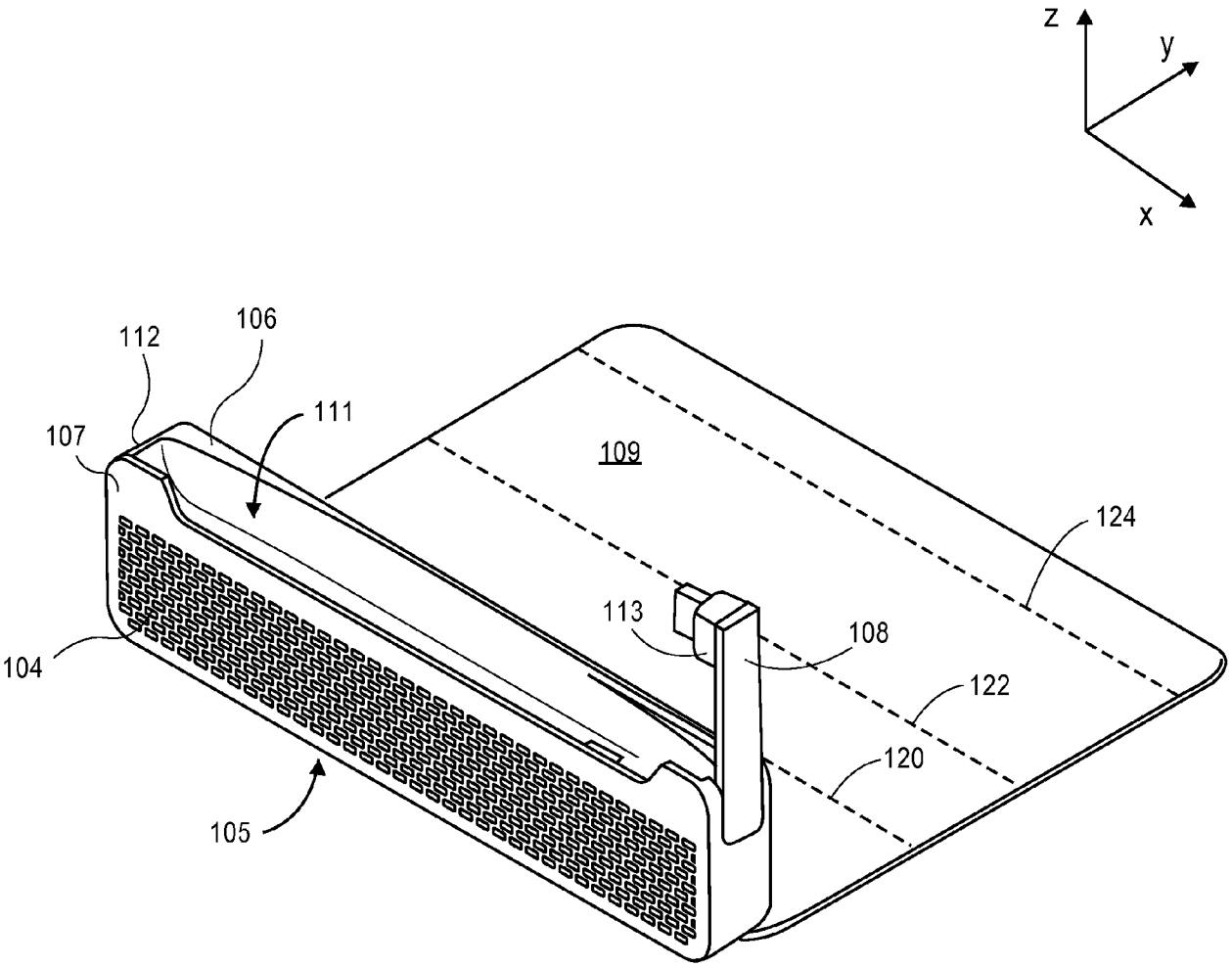
FIGS. 1B-1E are perspective views of an example peripheral speaker and cover, in accordance with some embodiments.

Referring to FIG. 1B, the exterior casing 104 includes a channel or groove 111 that is adapted to removably secure the electronic device 110. The channel 111 is at least partially defined by a front extension 107, a back extension 106, and a side extension 112 of the exterior casing 104. Accordingly, when the electronic device 110 is inserted into the channel 111, the front extension 107, the back extension 106, and the side extension 112 each cover a portion of the respective front side, back side, and side of the electronic device 110, as illustrated in FIG. 1A. Further, because the electronic device 110 is recessed within the channel 111, the front extension 107, the back extension 106, and the side extension 112 support the electronic device 110 and help to prevent the electronic device 110 from tipping forward, backward, or sideways.

According to embodiments, the length (x-dimension) of the peripheral speaker 105 is longer than the length (x-dimension) of the electronic device 110 to enable the electronic device 110 to fit within the channel 111. Similarly, the length (x-dimension) and width (y-dimension) of the channel 111 is sized to secure the electronic device 110 with minimal movement. Accordingly, the channel 111 may have a specific size and shape that depends on the type and/or model of the electronic device 110. Similarly, the bottom surface of the channel 111 may have different shapes (e.g., flat, curved, etc.) depending on the shape of the corresponding side of the electronic device 110.

Referring to FIG. 1B, the peripheral speaker 105 further includes a connector lead 108 that is connected on a first end to the side of the peripheral speaker 105 that is opposite from the side extension 112. The connector lead 108 is adapted to connect the driver(s) of the peripheral speaker 105 to the electronic device 110. The connector lead 108 may be considered part of the exterior casing 104 or separate from the exterior casing 104. In either implementation, at least the bottom portion of the connector lead 108 defines a remainder of the channel 111 that is not defined by the front extension 107, the back extension 106, and the side extension 112.

The connector lead 108 includes an adapter 113 that may be located at or near or connected to the end of the connector lead 108, where the adapter 113 may be configured to connect to a corresponding port of the electronic device 110. It should be appreciated that various types of the adapter 113 that are configured to connect to a corresponding port of the electronic device 110 are envisioned. For example, the adapter 113 can be a Lighting® connector, Thunderbolt connector, USB, mini USB, micro USB, HDMI, or the like. In some embodiments, the peripheral speaker 105 may include a power source (e.g., a battery) capable of charging a power source (e.g., a battery) of the electronic device 110 when the adapter 113 is connected to the electronic device 110. Similarly, the peripheral speaker 105 may be charged by an external power source via the connector lead 108 or via another port (not shown in figures).

The connector lead 108 (and the corresponding adapter 113) may be configured to facilitate audio-out functionality, whereby the driver(s) of the peripheral speaker 105 may output audio according to the electrical signal generated by the electronic device 110 and conducted by the connector lead 108 and the adapter 113. In certain embodiments, the connector lead 108 may have a length that is commensurate with the location of the corresponding port on the electronic device 110 (as illustrated in FIG. 1A), such that the connector lead 108 is fully extended or near-fully extended when the adapter 113 is inserted into the corresponding port of the electronic device 110 and the electronic device 110 is secured within the channel 111. In other embodiments, the connector lead 108 may have a variable or excess length such that the connector lead 108 is sized to fit a variety of electronic devices 110 or otherwise have excess length when the adapter 113 is inserted into the corresponding port on the electronic device 110.

The peripheral speaker system 100 further includes a cover 109 attached or secured to the peripheral speaker 105. It should be appreciated that the cover 109 may be permanently attached or secured to the peripheral speaker 105 or may be removably attached or secured to the peripheral speaker 105, as illustrated in more detail in FIG. 1C. The cover 109 may be composed of one or more materials or combinations of materials, whereby each side of the cover 109 may be of a different material. For example, the exterior (−z-dimension) side of the cover 109 may be polyurethane and the interior (+z-dimension) side of the cover 109 may be microfiber (or vice-versa). It should be appreciated that other materials or combinations of materials for the cover 109 are envisioned. Further, the cover 109 may have materials enclosed within one or more sections of the cover 109. For example, the cover 109 may enclose one or more magnets, metals, plastics, or other substrates.

Various portions or sections of the cover 109 are configured to flex or fold, or otherwise be manipulated. For example, as shown in FIG. 1B, the cover 109 has three seams or creases (120, 122, 124) at which the cover 109 is enabled to bend or fold. In embodiments, the seams 120, 122, 124 may correspond to locations of any materials or substrates that are enclosed or embedded within the cover 109. For example, the cover 109 may enclose a magnet that extends the length of the cover 109 (x-dimension) and is contained within (y-dimension) the seam 124 and the back edge of the cover 109. For further example, the cover 109 may enclose a plastic substrate that extends the length (x-dimension) of the cover 109 and is contained within the seams 122, 124 (y-direction). It should be appreciated that the locations and amount of the seams 120, 122, 124 are merely examples and that other locations and amounts are envisioned.

Figure 1C:
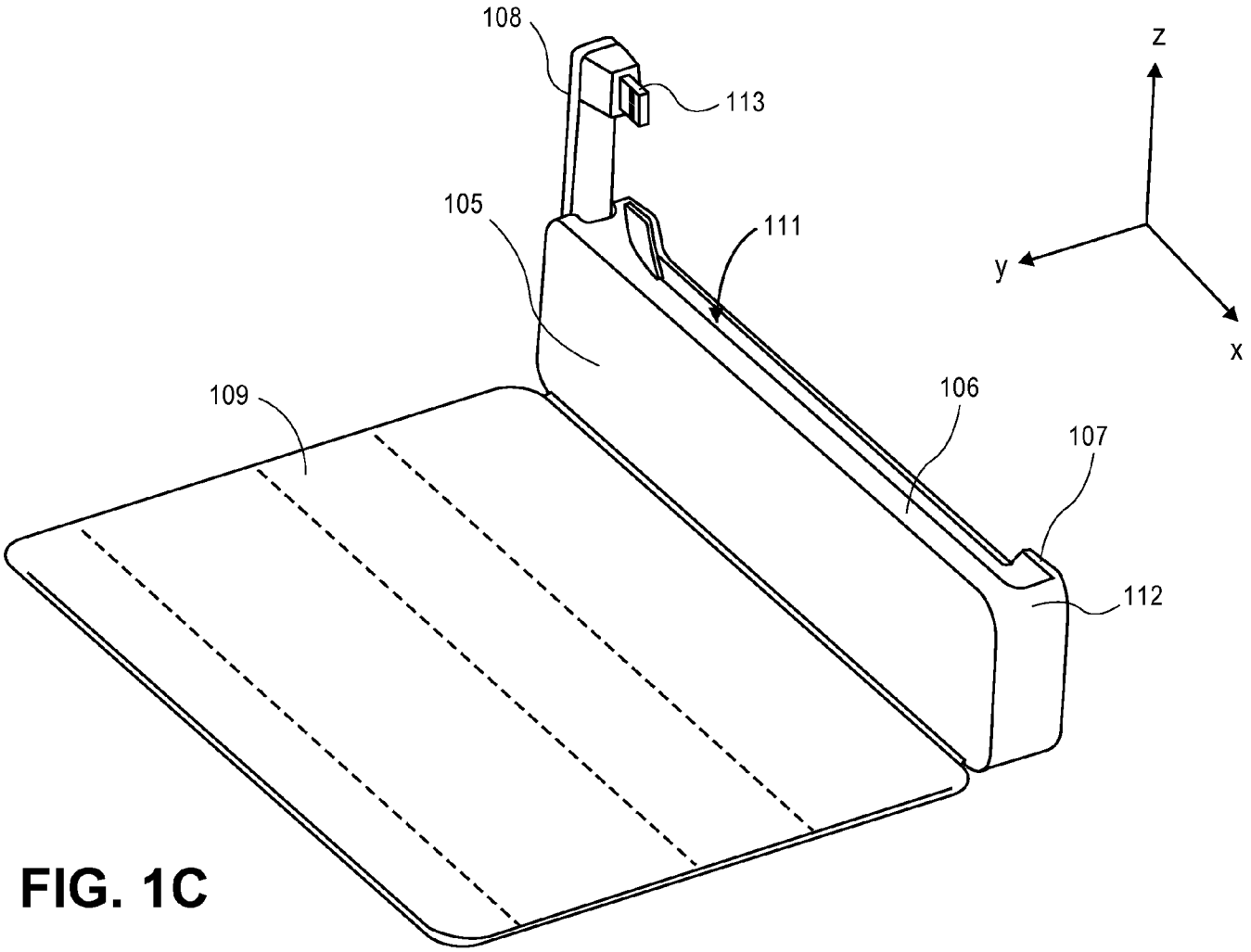
Figure 1D:
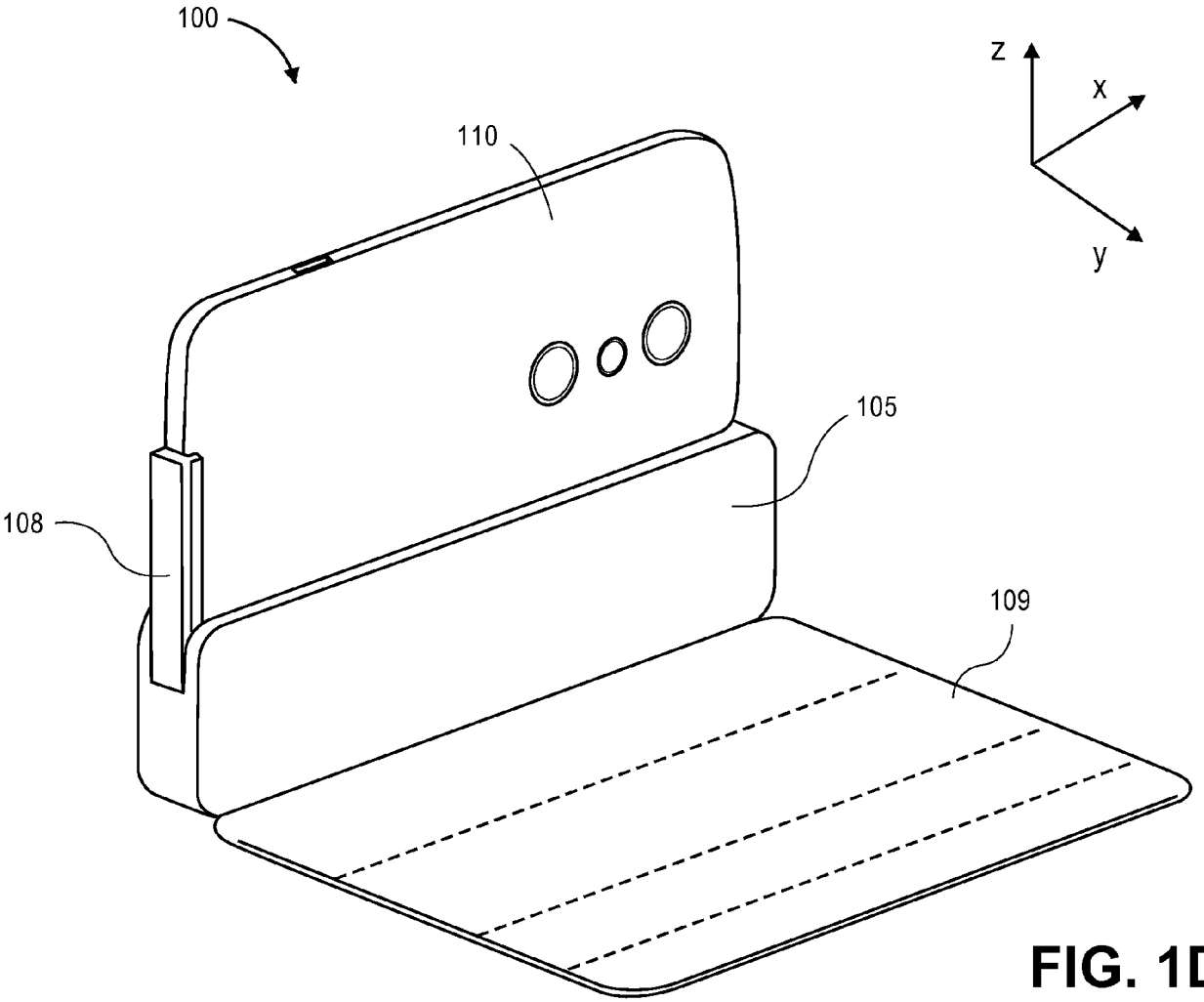
Figure 1E:
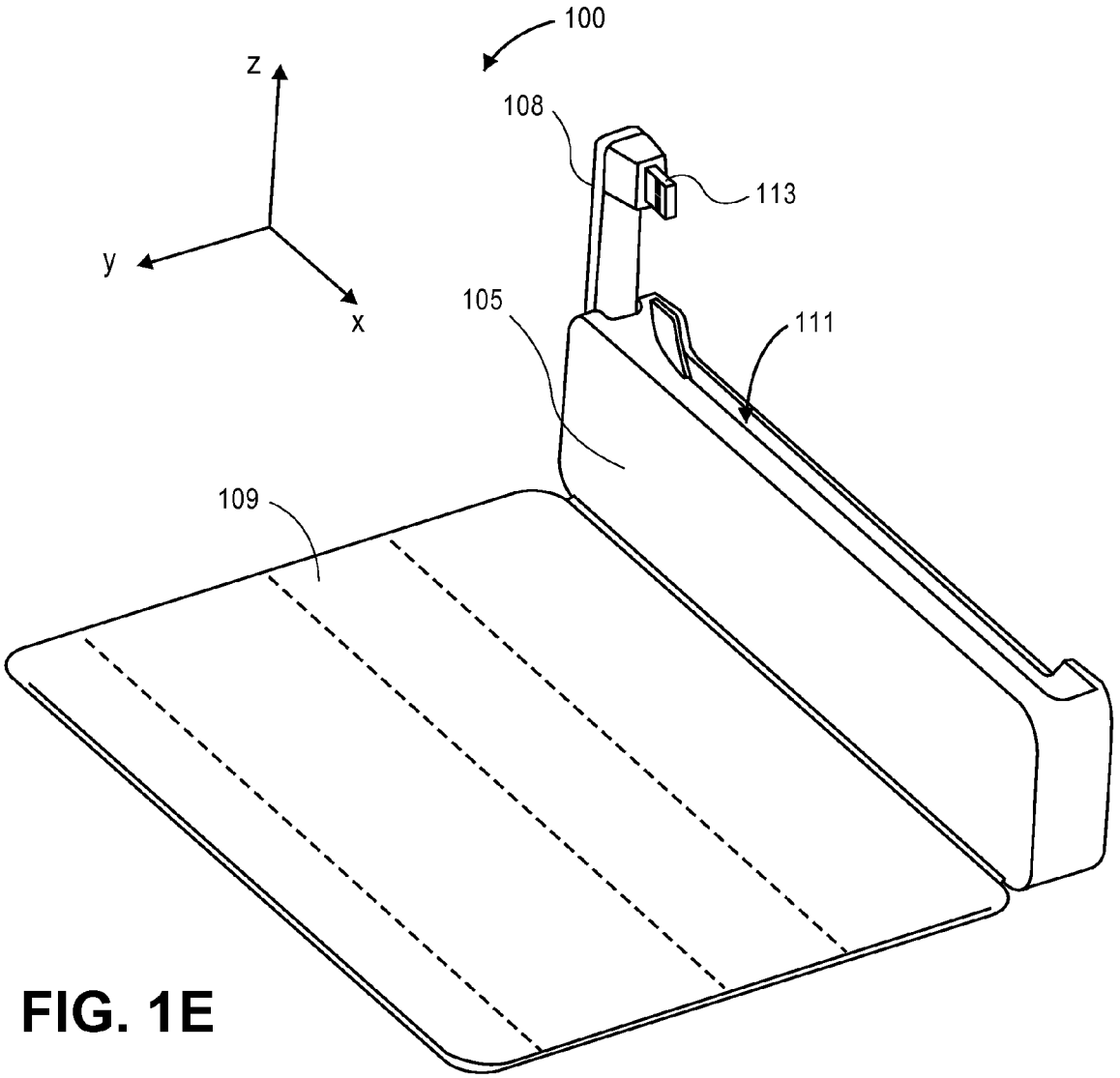

FIGS. 1D and 1E illustrate additional perspective views of the peripheral speaker system 100. In particular, FIG. 1D illustrates the electronic device 110 secured within the peripheral speaker 105 with the cover 109 protruding therefrom. FIG. 1E illustrates the peripheral speaker 105 with the defined channel 111 and connector lead 108.

As a benefit of the seams 120, 122, 124 as illustrated in FIG. 1C, the cover 109 is adapted to be arranged in multiple configurations, both with respect to itself and with respect to the peripheral speaker 105. Referring to FIG. 2A, a cover 209 (such as the cover 109 as discussed with respect to FIGS. 1A-1C), is adapted to fold upward and inward such that an end portion 232 of the cover 209 supports a peripheral speaker 205. In some embodiments, the end portion 232 may enclose a magnet and the portion of the peripheral speaker 205 that contacts the end portion 232 may be metal (i.e., the end portion 232 is magnetically attracted to the metal portion of the peripheral speaker 205). Of course, a connector lead 208 of the peripheral speaker 205 may be accessible to be connected to the port of the electronic device 210.

With the cover 209 in the configuration as illustrated in FIG. 2A, the cover 209 supports the peripheral speaker 205 and an electronic device 210 disposed within the peripheral speaker 205 when a bottom surface 231 of the cover 209 rests on a flat surface. Therefore, the configuration illustrated in FIG. 2A may facilitate many applications for the peripheral speaker 205 and/or the electronic device 210. For example, the configuration of FIG. 2A may enable hands-free music playback, voice calling, video conferencing, or the like.

Figure 2B:
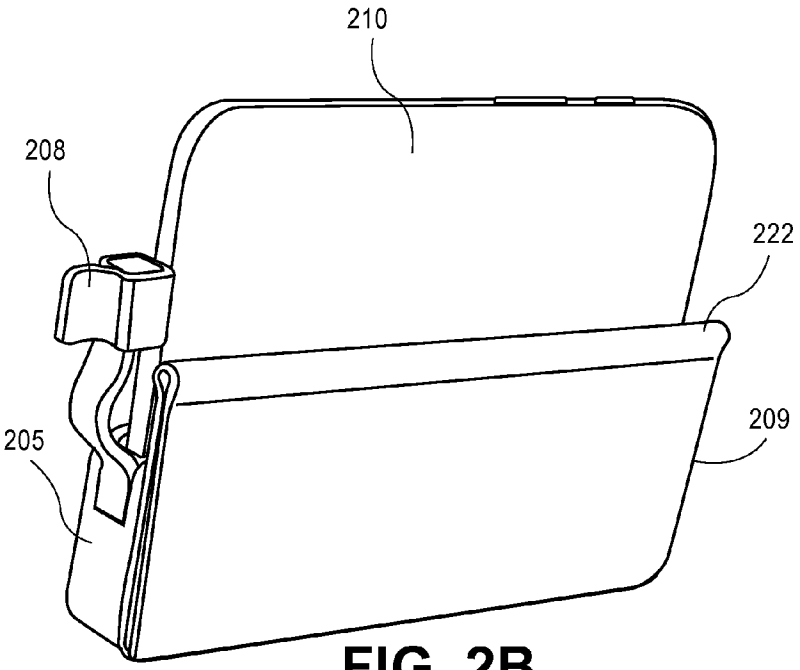
FIGS. 2A-2C are perspective views of various configurations for a peripheral speaker, a cover for the peripheral speaker, and/or an electronic device, in accordance with some embodiments.

FIG. 2B illustrates another configuration for the cover 209, the peripheral speaker 205, and the electronic device 210. In particular, the cover 209 is folded over at a seam 222 roughly halfway along the width of the cover so that the ends of the cover 209 line up. In some embodiments, the respective end portions of the cover 209 may be attracted to each other (e.g., via a set of magnets) so as to bias the configuration. Of course, the connector 208 may be accessible to be connected to the port of the electronic device 210. The configuration illustrated in FIG. 2B may facilitate many applications and benefits for the peripheral speaker 205 and/or the electronic device 210. For example, the configuration of FIG. 2B may enable a user to easily grip and/or hold the peripheral speaker 205 and the electronic device 210, such as during game play, or otherwise during interaction with the electronic device 210.

Figure 2C:
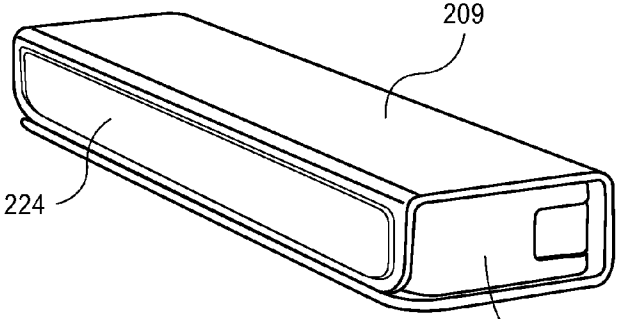
Figure 2A:
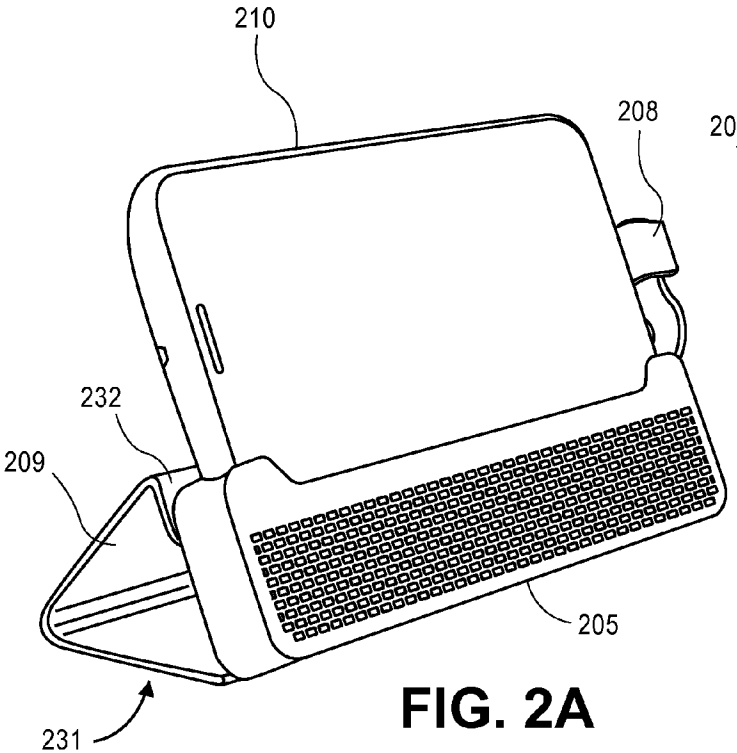

FIG. 2C illustrates a further configuration for the cover 209, the peripheral speaker 205, and the electronic device 210. In particular, the cover 209 as illustrated in FIG. 2C is adapted to "wrap" around the peripheral speaker 205 such that one edge of the cover 209 matches up with the opposite edge of the cover 209. In some embodiments, an end portion 224 of the cover 209 may be attracted to the peripheral speaker 205 (e.g., via magnet/metal combination) so as to bias the configuration. The configuration illustrated in FIG. 2C may facilitate many applications and benefits for the peripheral speaker 205. For example, the configuration of FIG. 2C may enable easy portability of the peripheral speaker 205. For further example, the configuration of FIG. 2C enables the cover 209 to protect the peripheral speaker 205 from various elements and accident events.

It should be appreciated that the configurations for the peripheral speaker 205 as depicted in FIGS. 2A-2C are merely examples and that other configurations are envisioned. Further, it should be appreciated that other fastening mechanism or components for securing or biasing the peripheral speaker 205 (and the cover 209) in the configurations are envisioned. For example, as an alternative to magnetic components as discussed herein, the cover 209 and/or the peripheral speaker 205 may include hook-and-loop (e.g., Velcro®) fastening components, snaps or buttons, tabs and/or slots, adhesive components, putty or other malleable materials, and/or the like.

The invention claimed is:

1. A peripheral speaker component, comprising:

an exterior casing comprising:

a channel formed substantially along a length of the exterior casing, wherein the channel is at least partially defined by a front extension, a back extension, and a side extension of the exterior casing, and a grill formed on a front surface of the exterior casing;

a connector lead having a first end connected to the exterior casing opposite from the side extension, wherein the connector lead additionally defines the channel of the exterior casing, and wherein the connector lead comprises a second end that extends above the channel of the exterior casing;

an adapter located at and connected to the second end of the connector lead, the adapter configured to connect to an electronic device; and at least one driver enclosed within the exterior casing and at least partially exposed to an exterior of the peripheral speaker component via the grill, wherein the at least one driver is configured to output audio corresponding to an electrical signal conducted via the connector lead.

2. The peripheral speaker component of claim 1, further comprising:

a cover extending from a bottom edge of the exterior casing, the cover including at least one seam that enables maneuverability of the cover.

3. The peripheral speaker component of claim 2, wherein the at least one seam of the cover encloses a magnet that is magnetically attracted to at least a portion of the exterior casing.

4. The peripheral speaker component of claim 2, wherein the cover is maneuverable to surround the exterior casing.

5. The peripheral speaker component of claim 1, wherein the at least one driver is configured to output the audio corresponding to the electronic signal that originates from the electronic device and is conducted via the connector lead.

6. The peripheral speaker component of claim 1, wherein the at least one driver comprises a first driver and a second driver that are arranged side-by-side within the exterior casing.

7. The peripheral speaker component of claim 1, further comprising:

a power source configured to supply power to the electronic device via the connector lead.

8. The peripheral speaker component of claim 1, wherein the channel is sized to secure the electronic device.

9. The peripheral speaker component of claim 8, wherein the connector lead has a length that is sized to connect to a port of the electronic device when the electronic device is secured within the channel.

10. The peripheral speaker component of claim 1, wherein the front extension extends to a height that is lower than that of the back extension.

11. A portable speaker, comprising:

an exterior casing comprising:

a channel formed substantially along a length of the exterior casing, wherein the channel is at least partially defined by a front extension, a back extension, and a side extension of the exterior casing, and a grill formed on a front surface of the exterior casing;

a connector lead having a first end connected to the exterior casing opposite from the side extension, wherein the connector lead comprises a second end that extends above the channel of the exterior casing;

an adapter located at and connected to the second end of the connector lead, the adapter configured to connect to an electronic device;

at least one driver enclosed within the exterior casing and at least partially exposed to an exterior of the portable speaker via the grill, wherein the at least one driver is configured to output audio corresponding to an electrical signal conducted via the connector lead; and a cover extending from a bottom edge of the exterior casing, the cover including at least one seam that enables maneuverability of the cover.

12. The portable speaker of claim 11, wherein the connector lead additionally defines the channel of the exterior casing.

13. The portable speaker of claim 11, wherein the at least one seam of the cover encloses a magnet that is magnetically attracted to at least a portion of the exterior casing.

14. The portable speaker of claim 11, wherein the cover is maneuverable to surround the exterior casing.

15. The portable speaker of claim 11, wherein the at least one driver is configured to output the audio corresponding to the electronic signal that originates from the electronic device and is conducted via the connector lead.

16. The portable speaker of claim 11, wherein the at least one driver comprises a first driver and a second driver that are arranged side-by-side within the exterior casing.

17. The portable speaker of claim 11, further comprising:

a power source configured to supply power to the electronic device via the connector lead.

18. The portable speaker of claim 11, wherein the channel is sized to secure the electronic device.

19. The portable speaker of claim 18, wherein the connector lead has a length that is sized to connect to a port of the electronic device when the electronic device is secured within the channel.

20. The portable speaker of claim 11, wherein the front extension extends to a height that is lower than that of the back extension.

* * * * *